US005755827A

United States Patent [19]

Bamford et al.

[11] Patent Number: 5,755,827

[45] Date of Patent: May 26, 1998

[54] METHOD FOR THE TREATMENT OF WOOL

[75] Inventors: Susan Bamford, Ripley; John Ellis, Duffield; Kenneth Michael Huddlestone, Allestree, all of England

[73] Assignee: Precision Processes Textiles, England

[21] Appl. No.: 256,049

[22] PCT Filed: Dec. 23, 1992

[86] PCT No.: PCT/GB92/02388

§ 371 Date: Jun. 20, 1994

§ 102(e) Date: Jun. 20, 1994

[87] PCT Pub. No.: WO93/13260

PCT Pub. Date: Jul. 8, 1993

[30] Foreign Application Priority Data

Dec. 23, 1991 [GB] United Kingdom ..... 9127235

[51] Int. Cl.[6] ..... D06M 11/50; D01C 3/00

[52] U.S. Cl. ..... 8/128.3; 8/128.1; 8/110; 8/111; 8/465; 8/453; 8/139

[58] Field of Search ..... 8/128.3, 128.1, 8/110, 111, 465, 453, 139; 252/8.7, 8.9, 96, 103, 107, 105, 100, 95, 186.1, 188.2

[56] References Cited

U.S. PATENT DOCUMENTS

| | | | |
|---|---|---|---|
| 3,839,234 | 10/1974 | Roscoe | 510/435 |
| 5,087,266 | 2/1992 | Connell et al. | 8/128.3 |

FOREIGN PATENT DOCUMENTS

| | | | |
|---|---|---|---|
| 1468081 | 2/1967 | France . | |
| 716806 | 10/1954 | United Kingdom | 8/128.3 |
| 2044310 | 10/1980 | United Kingdom . | |
| 91/02117 | 2/1991 | WIPO . | |
| 92/00412 | 1/1992 | WIPO . | |

*Primary Examiner*—Alan Diamond
*Attorney, Agent, or Firm*—Wenderoth, Lind & Ponack

[57] ABSTRACT

A method for the treatment of wool so as to impart shrink resistance and which comprises treating the wool simultaneously with permonsulphuric acid, or a salt thereof, one or more scouring or wetting agents and one or more fiber swelling or dispersing agents. In a preferred embodiment, the method of treatment further comprises subjecting the wool to a polymer treatment. The method may be operated either as a continuous or as a batch process.

12 Claims, No Drawings

METHOD FOR THE TREATMENT OF WOOL

This is a 371 of PCT/GB92/02388 filed Dec. 23, 1992.

This invention relates to a method for the treatment of wool so as to impart shrink resistance, and which involves treating the wool simultaneously with permonosulphuric acid, a scouring or wetting agent and a fiber swelling or dispersing agent.

Many ways of rendering wool shrink resistant are known. These typically involve subjecting the wool to an oxidative treatment alone or, more commonly nowadays, followed by a polymer treatment.

Various two-step shrink-proofing processes in which wool is treated first with a chlorinating oxidative agent and subsequently with a pre-formed synthetic polymer have been developed. A wide variety of polymers can be used in aqueous solution or dispersion, including polyamide-epichlorohydrin resins and polyacrylates. A review of work in this field by J. Lewis appears in Wool Science Review, May 1978, pages 23–42. British Patent Nos. 1,074,731 and 1,340,859, U.S. Pat. Nos. 2,926,154 and 2,961,347 and European Patent Application No. 0129322A, for example, describe two-step shrink-proofing processes and resins or polymers suitable for use therein.

A number of chlorinating oxidative treatments, or pre-treatments, for use on wool are well known. The source of chlorine may be chlorine gas supplied from cylinders, chlorinating agents such as hypochlorite and dichloroisocyanuric acid and their salts. For example, British Patent No. 569,730 describes a batch shrink-proofing treatment involving hypochlorite and potassium permanganate; British Patent No. 2,044,310 describes a treatment with an aqueous solution of permanganate and hypochlorite. In all cases the active principle remains the same.

Permonosulphuric acid and its salts have been known for some time to confer reasonable levels of shrink resistance to wool either when used alone, as disclosed in British Patent No. 1,084,716, or in combination with a chlorinating agent, as disclosed in British Patent No. 1,073,441. British Patent No. 738,407 describes a process for the manufacture of permonosulphuric acid from hydrogen peroxide and concentrated sulphuric acid. The product is said to be suitable for use as a bleaching agent and various other purposes. British Patent Nos. 872,292 and 991,163 disclose processes for the shrink-proofing of wool which comprise treating the wool with permonosulphuric acid and a permanganate, or with an aqueous solution of permonosulphuric acid at a temperature in excess of 70° C., respectively. British Patent No. 1,071,053 describes a treatment for imparting shrink resistance to wool which comprises first applying an aqueous solution of permonosulphuric acid, or a salt thereof, and subsequently treating the wool with an aqueous solution of hydrogen peroxide. The teaching is limited to a sequential or two-step treatment and the level of shrink resistance achieved is, by today's standards, very low. British Patent No. 1,118,792 describes a shrink resist treatment which comprises treating the wool with permonosulphuric acid, a permanganate and dichloroisocyanuric acid or trichloroisocyanuric acid and, optionally, also with sulphurous acid or a salt thereof.

The oxidative treatment of garments using permonosulphuric acid proceeds at a much slower rate than when a chlorinating agent is used. Often the slowness of reaction is linked to a poorer result, and this is still the case even when great care has been taken to remove oil and other contaminants, prior to the shrink resist treatment, by performing multiple scouring operations on the wool using detergent.

The level of shrink resistance which can be attained using oxidative treatments of the above-mentioned kinds alone is, generally speaking, not sufficient to meet the exacting modern standards set for shrink resist performance. It is common practice with chlorine-based oxidative treatment processes, which do not in themselves generate the full shrink resistance for IWS TM31 5x5A wash performance, to apply a polymer to the wool to generate a further shrink resist effect capable of meeting the standard. Few polymers are known which will adhere satisfactorily to wool that has been treated with permonosulphuric acid alone, and result in wool which fully meets the requirements set today by the International Wool Secretariat (IWS) for machine washability (e.g. the IWS TM31 standard). This is particularly true with regard to treatments on wool top and worsted spun yarn or garments. Only those processes where the application of permonosulphuric acid is accompanied by chlorination (e.g. in the form of hypochlorite or dichloroisocyanurate) are usually able to reach an acceptable standard of shrink resistance.

In order to produce wool with a machine washable (or "Superwash") standard of shrink resist performance, by the continuous processing of wool tops, it has therefore been necessary to subject the wool to an oxidative treatment involving the use of chlorine. In recent years, however, increasing concern has been expressed about the generation of chlorinated residues during Superwash treatments and their damaging effects on the environment. Such residues are coming under closer scrutiny and discharge levels are being set for the amount of absorbable organic halogen (AOX) which can be released from shrink resist processing machinery. It has therefore become desirable, indeed essential, to find some means of reducing the level of AOX discharge from such operations. The present invention seeks to provide a non-chlorine oxidative treatment, or pre-treatment, for rendering wool shrink resistant.

According to the present invention there is provided a method for the treatment of wool so as to impart shrink resistance and which comprises treating the wool simultaneously with permonosulphuric acid, or a salt thereof, one or more scouring or wetting agents and one or more fiber swelling or dispersing agents.

It has surprisingly been found that treatment of previously unscoured wool with permonosulphuric acid at the same time as with a scouring or wetting agent and a fiber swelling or dispersing agent imparts an increased level of shrink resistance. In addition to improved shrink resistance, this technique also results in an increase in the rate of exhaustion of the permonosulphuric acid on to the wool such that treatment times are achieved which equal those normally found with chlorinating agents. Unexpectedly, the use of permonosulphuric acid in the scour bath does not adversely affect oil removal from the wool, if anything it is actually enhanced, and garments with a very low oil content are thus produced.

With regard to the simultaneous treatment of the wool with permonosulphuric acid, a scouring or wetting agent and a fiber swelling or dispersing agent, which characterises the method of this invention, this may be performed in several ways. Most preferably, however, the three components are mixed together to form a single solution and this is then applied to the wool. Alternatively, either the scouring/wetting agent or the fiber swelling or dispersing agent could be applied to the wool by a padding or other technique, the wool then being passed into a bath containing the other two components. Interaction between the permonosulphuric acid, the scouring/wetting agent and the fibre swelling or dispersing agent would then occur simultaneously when the wool enters the bath. It is to be understood that this type of approach is within the scope of the present invention.

The permonosulphuric acid is typically used at levels of from 0.1 to 6.0% by weight on the weight of the dry wool, preferably from 0.5 to 4.5%. It will be understood that salts of permonosulphuric acid may be used. It will also be understood that substances which are capable of generating permonosulphuric acid upon reaction, such as a mixture of concentrated sulphuric acid and concentrated hydrogen peroxide, may be used as sources of permonosulphuric acid. In the latter case, known and controlled excesses of hydrogen peroxide would be used and there would need to be provision for cooling and diluting the mixture following the in situ generation of permonosulphuric acid.

The scouring or wetting agent is typically used in an amount of from 0.25 to 10.0% by weight on the weight of the dry wool, preferably from 0.5 to 3.0%. Typically, the scouring/wetting agent is an anionic or non-ionic surfactant. It should be a non-soap based formulation which is capable of operating at low pH values. Examples of suitable anionic surfactants include linear alkyl sulphates, dodecyl benzene sulphonates, petroleum sulphonates, alkyl ether sulphates and carboxylated alkylene oxide derivatives. Most preferably, the surfactants are based on alkylene (in particular, ethylene) oxide derivatives of fatty alcohols, phenols, alkyl phenols, fatty acids or fatty amides, and will be selected for use on the basis of the nett HLB value for the surfactant depending on whether the main effect required is oil and soil removal (as in batch processing) or wetting (as in continuous processing). It will be understood that mixtures of two or more scouring/wetting agents may be employed.

The fiber swelling or dispersing agent is typically used in an amount of from 0.1 to 10.0% by weight on the weight of the dry wool, preferably from 0.3 to 3.0%. The fiber swelling or dispersing agents may be selected from a wide range of materials which typically enhance water uptake by the wool fiber, such as urea, formic acid, benzyl alcohol, and other materials identified in the literature relating to low temperature wool dyeing. Particularly preferred are surfactants, which are known to cause fiber swelling, but which are not normally associated with detergency, in particular long chain ethylene oxide derivatives of fatty alcohols, fatty acids or alkyl phenols, where the proportion of ethylene oxide in the molecule exceeds 70%, and preferably 80%, by mass. It will be appreciated that a mixture of two or more such agents may be employed.

It would be possible for both the scouring/wetting agent and the fiber swelling or dispersing agent to be present as a single preformulated composition. When the scouring/wetting agent is a non-ionic surfactant, the inclusion of substances with a higher molecular weight than would normally be included for the purposes of producing a scouring/wetting agent would lead to a single composition (containing a spread of high molecular weight and low molecular weight units) which could fulfil the functions of both scouring/wetting agent and fiber swelling or dispersing agent. It is to be understood that such an approach is within the scope of the present invention. It is to be further understood that the above-mentioned inclusion may be as a result either of deliberate mixing of suitable ethylene oxide derivatives, or by deliberate control of the manufacturing process for the ethylene oxide derivative. It is a characteristic of this process that it produces a mixture of molecules having differing numbers of ethylene oxide residues in the molecule, the amounts of each molecule type produced being statistically distributed around the target value. By modification of the process conditions, it is possible to vary the breadth and shape of the distribution curve for a particular product, and so include molecules which fall into both the definition of the scouring/wetting agent and swelling or dispersing agent in the same reaction product.

Preferably, though not necessarily, the method of the invention includes a polymer treatment of the wool. In principle, any polymer that is capable of adhering or exhausting on to the wool (following a pre-treatment of the aforementioned type) is suitable for use. As indicated above, problems have been encountered when applying polymers to wool that has been treated by permonosulphuric acid alone. Having regard to the improved level of shrink resistance achieved by the combined use of permonosulphuric acid, a scouring/wetting agent and a fiber swelling or dispersing agent, however, polymer treatments which might otherwise be considered only partially effective (when used on wool treated with permonosulphuric acid alone by conventional processing), can be used successfully in the method of this invention.

Polymers available for use include those described in European Patent Applications Nos. 0129322A, 0260017A, 0315477A and 0414377A, the Hercosett polymers, Basolan SW polymer, silicone polymers and the Dylan Ultrasoft polymers. Mixtures of two or more polymers may be employed, either in pre-mixed form or through separate dosings. One obvious restriction, however, is that the polymer(s) chosen must be suited to the further processing to which the wool will be subjected. As is well known, for example, certain silicones may not be suitable on wool which has to be subsequently spun into yarn because of the undesirable effects that this type of polymer system can have on the spinning operation.

The application of the polymer to the wool will normally be carried out in the conventional manner from a bath, using the amounts and conditions appropriate for the particular polymer system and which are well known in the art and need not be repeated here in detail. The total amount of polymer solids applied to the wool fiber is generally from 0.005 to 10.0% by weight, most preferably from 0.05 to 2.0%

It has been found that if the polymer is applied to the wool top in its acidified state, prior to neutralisation of the residual peroxy compounds and/or acidity on the wool, an enhancement of the anti-shrink effect is obtained. This benefit is particularly noted when certain types of polymers, such as silicone polymers, or mixtures of polymers are used. Neutralization may be performed using aqueous sodium sulphite. It has been found desirable to add a small amount of sodium meta-bisulphite to some polymer baths. This assists in the exhaustion of the polymers concerned on to the wool and enables processing at higher speeds. It has further been found advantageous to perform the sulphite neutralisation step in the presence of a further quantity of scouring/wetting agent.

Subsequent to the polymer treatment the wool is dried and may then be further processed in the usual manner.

The method of this invention can be performed using conventional equipment, such as the apparatus used in the standard padding technique. For example, the scouring/wetting agent and the fiber swelling or dispersing agent may preferably be mixed with the permonosulphuric acid immediately prior to feeding the liquor to the pad whilst the top is being drawn through the rollers. The apparatus described in British Patent No. 2,044,310 could be utilized. It has, however, been found advantageous to allow the surfactants fractionally more time to induce fiber swelling than would be achieved using a horizontal pad mangle. This can best be accomplished by running the slivers through a trough of pad liquor prior to either a horizontal or preferably vertical pad mangle such that the slivers are heavily saturated with liquor prior to padding.

The method may be operated either as a continuous or as a batch process. It will be appreciated that in batch processing the use of a surfactant with scouring properties would be most desirable, whereas in a continuous operation the presence of a surfactant with wetting properties is preferred. The choice of surfactant would be made accordingly. In the case of continuous processing, a superior result is obtained using a higher level of wetting agent than would be required purely for wetting agent purposes, and that wetting agent should preferably be based on non-ionic rather than anionic surfactants.

The wool for treatment may be in any suitable form from loose wool to finished garments, dyed or undyed, including top, slivers, roving, yarn or carded web, provided or course that suitable mechanical means are available to facilitate handling and treatment of wool in these forms.

It has been found that subjecting wool to simultaneous treatment with permonosulphuric acid, a scouring or wetting agent and a fiber swelling or dispersing agent, together with a suitable polymer treatment, can produce a shrink resistant wool which is capable of meeting the full requirements of the IWS TM31 standard for machine washable wool. In addition, the resultant wool generally has a whiter appearance than that which is obtainable using chlorinating treatments (chlorination is well known to cause yellowing of the wool). Wool having a soft, natural handle is produced by the method.

With regard to the use of the mixture of permonosulphuric acid, a scouring/wetting agent and a fibre swelling or dispersing agent, the speed of reaction and hence the levelness of the treatment may be controlled using the parameters of pH, dilution and temperature. Turning to the polymer treatment, when present, the polymer (or mixture of polymers) used is chosen so as to cause no problems with mechanical operations such as gilling and spinning and are fully resistant to dyeing. The method has the significant benefit that it may be performed in existing equipment with little or no modification being necessary.

From the environmental viewpoint, the method has the advantage of avoiding the oxidation of wool by chlorine during its operation. This makes it possible to greatly reduce or even eliminate the presence of absorbable organic halogen (AOX) in the effluent which results from the shrink resist treatment of wool and its subsequent dyeing. There will also be no hazard from chlorine gas fumes around the treatment plant and no need (unlike in the case of processes involving gas chlorination) for the bulk storage on site of highly toxic materials. Furthermore, in the case of batch processing, the method of this invention results in the use of less water and surfactant than with conventional chlorine or permonosulphate processes; thus reducing wastage and decreasing the load on effluent treatment facilities.

The present invention will now be illustrated by the following Examples.

In these Examples, the following trademarked items are employed where indicated:

| Name | Generic Description & Manufacturer |
|---|---|
| MILLSCOUR LTA, XAN | Range of scouring agents; PPT (Precision Process Textiles) |
| CAROAT | Potassium salt of permonosulphuric acid; Degussa |
| CUROX | Potassium salt of permonosulphuric acid; Interox |
| SYNPERONIC | Range of non-ionic surfactants; ICI (Imperial Chemical Industries) |
| FULLWET | Non-ionic wetting agent; PPT |
| WETTER CPA, OSA, WA | Wetting agents; PPT |
| POLYMER EC, RSM | Proprietary polymers; PPT |

EXAMPLE 1

2/16 woollen-spun lambswool swatches were treated as outlined below, then submitted to wash testing for felting shrinkage according to test method TM31 of the International Wool Secretariat.

a) Two swatches were scoured at a liquor ratio of 30:1 and a temperature of 40° C. in two sequential baths containing 4% on weight of wool (oww) and 2% oww respectively of a non-ionic detergent (MILLSCOUR XAN, Precision Processes Textiles (PPT), Ambergate, Derby, UK). The swatches were rinsed thoroughly and hydroextracted. The swatches were then treated with potassium permonosulphate, "X-salt", (e.g. CAROT Degussa or CUROX Interox), at a level of 4.5% oww by drip feeding a dilute solution of the salt into a bath containing the swatches at a liquor ratio of 30:1, pH4 and 40° C. The swatches were agitated in the treatment bath until the active component of the salt was completely exhausted, as determined by titration with standard sodium thiosulphate solution, using potassium iodide solution as an indicator. To the spent X-salt bath was added sodium sulphite solution (25% oww of a 25% w/w solution), and the pH adjusted to pH8 with sodium bicarbonate. The swatches were removed from solution after 20 minutes, rinsed thoroughly in clean water and hydroextracted.

One swatch was then further treated with polymer. The swatch was put in a bath at a liquor ratio of 30:1, neutral pH and 3% oww—as a diluted solution—of POLYMER RSM (PPT) was drip-fed into the bath over a period of 10 minutes, with constant agitation. The bath was then heated to 40° C. and the swatch further agitated until the polymer had completely exhausted from solution (as seen by a clearing of the turbidity). The swatch was then hydroextracted and dried.

b) A similar process to that described above was used, with the exceptions that:

i) no separate scouring regime was used;

ii) the X-salt treatment bath additionally contained 1% oww of non-ionic detergent and 2% oww of a 30% solution of nonyl phenol 50 mole ethoxylate:

iii) 50% oww of sodium sulphite solution was added to the spent X-salt treatment bath (as determined by titration), together with a further 1% oww of non-ionic detergent.

The results of wash testing to IWS TM31 are given in Table 1.

TABLE 1

| Treatment | X-salt exhaustion time | TM31 2 × 5A |
|---|---|---|
| Example 1a | 40 mins | −29.6% |
| Example 1a + POLYMER RSM | | −9.2% |
| Example 1b | <15 mins | −16.8% |
| Example 1b + POLYMER RSM | | −3.1% |

Note: a negative figure indicates a shrinkage, positive figure indicates an extension.

EXAMPLE 2

2/24 worsted spun botany wool swatches were prepared as follows:

a) Two swatches were scoured at a liquor ratio of 30:1 and a temperature of 40° C. for 20 minutes in a solution containing 1% oww of non-ionic detergent (as in Example 1a). and 3% oww sodium bicarbonate. The swatches were rinsed and hydroextracted. Both swatches were then oxidatively pretreated with X-salt by the method described in Example 1a, with the exception that 6% oww of X-salt was used.

One swatch was further treated with 6% oww of POLYMER GC (PPT), by the method described in the latter part of Example 1a.

b) Two swatches were treated by the method described in Example 1b, with the exception that 6% oww of X-salt was used. One swatch was further treated with 6% of POLYMER EC.

c) Two swatches were treated by the method described in Example 1b, with the exception that no non-ionic detergent was added to the X-salt treatment bath. One swatch was further treated with 6% oww of POLYMER EC.

The swatches were all tested for felting shrinkage by TM31 of the IWS. The results are given in Table 2.

TABLE 2

| Treatment | X-salt exhaustion time | TM31 2 × 5A |
|---|---|---|
| Example 2a | 35 mins | −48.8% |
| Example 2a + POLYMER EC | | −11.1% |
| Example 2b | 20 mins | −23.9% |
| Example 2b + POLYMER EC | | −3.6% |
| Example 2c | 25 mins | −41.0% |
| Example 2c + POLYMER EC | | −8.0% |

EXAMPLE 3

A padding technique was used to oxidatively pretreat 2/21 worsted spun lambswool swatches, using different wetting agents in the treatment liquor. The swatches were wet-out in a trough containing the pretreat liquor, as described in Table 3. The swatches were then passed through a horizontal pad mangle and excess liquor squeezed out to give a total liquor pick-up of 100% by weight. The swatches were then allowed to stand for 10 minutes, and were then neutralized in a bath containing 40 g/l sodium sulphite (adjusted to pH8) for 10 minutes. The treated swatches were cut in half and one half of each was further treated with 4% oww of POLYMER EC by the method described in Example 1a.

The swatches were tested for felting shrinkage using a Cubex, as described in British Standard 1955. The results are presented in Table 3.

TABLE 3

| Wetting agent (= solids) | Area felting shrinkage, 2 hours Cubex | |
|---|---|---|
| | pretreat only | +Polymer EC |
| 5 g/l FULLWET (PPT) | −20.0% | −8.8% |
| 4.7 g/l WETTER DPA (PPT) | −23.0% | −30.2% |
| 6.4 g/l WETTER OSA (PPT) | −32.9% | −30.2% |
| 13.4 g/l WETTER WA (PPT) | −33.2% | −27.3% |
| 3.9 g/l sodium lauryl sulphate | −32.7% | −27.6% |

Note: all pretreatment liquors comprised the following:
40 g/l X-salt
3.9 g/l wetting agent (amount used adjusted to take into account varying active solids contents)
pH 2
30° C.

EXAMPLE 4

Two formulations comprising the following were prepared:

a) A solution containing 30 parts (by weight) nonyl phenol 50 mole ethoxylate and 70 parts water was prepared.

b) 20 parts of the solution from Example 4a was mixed with 80 parts of isodecanol 6 mole ethoxylate (e.g. SYNPERONIC 10/6 ex ICI Surfactants), to give a clear homogeneous solution.

EXAMPLE 5

2/24 worsted spun botany wool swatches were oxidatively pretreated by a padding technique as described in Example 3. Various additions were made to the pretreatment liquor as outlined in Table 4. After oxidation and sulphite neutralization, the swatches were cut in half and one half of each swatch was further treated with 6% oww of POLYMER EC by the method described in Example 1a. The exceptions were Examples 5d and 5e. Here the polymer (POLYMER EC) was co-applied to the wool during the oxidative pretreatment, prior to sulphite neutralization. No further polymer was applied in these cases.

The swatches were tested for felting shrinkage according to TM31, and the results are presented in Table 4.

TABLE 4

| Pretreat liquor additions | 3 × 5A | 5 × 5A | comments |
|---|---|---|---|
| 5a + 7.5 g/l FULLWET | | | |
| pretreat only | −18.4% | −27.7% | |
| + POLYMER EC | −1.0% | −2.1% | |
| 5b (+ 7.5 g/l FULLWET (+ 2 g/l Example 4a | | | |
| pretreat only | −7.4% | −5.3% | |
| + POLYMER EC | +4.3% | −5.5% | |
| 5c + 10 g/l Example 4b | | | |
| pretreat only | −1.8% | −10.4% | |
| + POLYMER EC | −4.0% | −4.9% | |
| 5d (+ 7.5 g/l FULLWET (+ 60 g/l POLYMER EC | −6.2% | −2.1% | polymer unstable at this pH |

TABLE 4-continued

| Pretreat liquor additions | 3 × 5A | 5 × 5A | comments |
|---|---|---|---|
| 5e (+ 10 g/l Example 4a | | | stable |
| (+ 60 g/l POLYMER EC | −6.2% | −3.1% | |

Note: all oxidative pretreat solutions comprised the following:
60 g/l X-salt
32 ml/l hydrogen peroxide solution solution (35% v/v)
wetting agent and fiber swelling/dispersing agent as in Table 4
pH 2
30° C.

EXAMPLE 6

2/16 woollen garments (ecru) were processed in a 90 liter side paddle machine as follows. 2 kg of goods were placed in the machine containing 1% (on weight of wool, oww) of non-ionic scouring agent, 2% (oww) dispersant (as described in Example 4b) and 1% (oww) formic acid in 60 liters of clean water at a temperature of 40° C. The goods were agitated in the machine at a high speed to achieve the desired level of cover or milling. The machine speed was reduced to low and 4.5% (oww) potassium peroxymonosulphate added, as a diluted solution via the feed hopper. The solution was added over a period of 10 mins. When all of the peroxymonosulphuric acid had exhausted (as determined by titration), 10% (oww) of sodium sulphite (anhydrous) and a further 1% (oww) of the non-ionic scouring agent were added to the bath and the goods processed for a further 10 minutes. The treatment water was then drained and the goods rinsed in two fresh baths of water. The goods were dyed by a suitable recipe for wool to the desired shade in the same machine. After dyeing, the goods were polymer treated in the machine by addition of 4% (oww) of POLYMER RSM via the feed hopper. The machine contained 60 liters of water at pH 6.5 and a temperature of 25° C. Ten minutes after addition of the polymer, the temperature was raised to 40° C. and the goods further processed for 10–15 minutes or until the turbidity in the bath had cleared.

The garments so processed easily achieve the standards set for Superwash by the International Wool Secretariat, that is 2×5A cycles of the TM31 test method.

EXAMPLE 7

Pre-dyed worsted spun wool-nylon (60/40) socks were treated in a side paddle machine by a process similar to that described in Example 6, omitting the milling operation and the dyeing step. A level of 6% (on weight of goods, owg) of potassium peroxymonosulphate was used and in place of POLYMER RSM, an alternative polymer (POLYMER EC, Precision Processes Textiles) at a level of 5% owg was used.

The socks met and exceeded the wash standards required for wool and woolblend socks. In a separate evaluation of wash and wearing characteristics, the socks compared very favorably against similar socks processed by the conventional chlorination/polymer process, widely used in the UK for shrinkproofing wool socks.

EXAMPLE 8

2/16 lambswool swatches were processed in an identical manner to htat described in Example 1b with the exception that an anionic scouring agent (MILLSCOUR LTA, Precision Processes Textiles) replaced the non-ionic scouring agent. No differences in performance were noted when processing by this route.

EXAMPLE 9

A number of alternative dispering or fibre swelling agents were evaluated. 2/16 lambswool swatches were processed as described in Example 1b, with the exception that the following dispersing agents replaced the solution of nonyl phenol 50 mole ethoxylate. All were used at an equivalent level.

Nonyl phenol 35 mole ethoxylate

Castor oil 40 mole ethoxylate

C12–14 fatty alcohol ethoxylate 36 mole ethoxylate

C12–14 fatty alcohol ethoxylate 47 mole ethoxylate

In all cases where the alternative dispersant was used a similar result was obtained with respect to the treatment process itself and the subsequent improvement in the wash-test performance to 2×5A cylcles of TM31.

We claim:

1. A method for the treatment of wool so as to impart shrink resistance which comprises treating the wool simultaneously with permonosulfuric acid, or a salt thereof, one or more scouring or wetting agents and one or more fiber swelling or dispersing agents, wherein said one or more fiber swelling or dispersing agents are different from said one or more scouring or wetting agents.

2. The method as claimed in claim 1, wherein after said treating, the wool has residual peroxy compounds, and the residual peroxy compounds are subsequently neutralized in the presence of a further quantity of scouring or wetting agent.

3. The method as claimed in claim 2, which further comprises subjecting the wool to a polymer treatment.

4. The method as claimed in claim 3, wherein the polymer treatment is performed prior to the said residual peroxy compounds being neutralized in the presence of a further quantity of scouring or wetting agent.

5. The method as claimed in claim 1, which further comprises subjecting the wool to a polymer treatment.

6. The method as claimed in claim 1, wherein the scouring or wetting agent comprises a non-ionic or anionic surfactant.

7. The method as claimed in claim 1, wherein the scouring or wetting agent is an alkylene oxide derivative of a fatty alcohol or alkyl phenol.

8. The method as claimed in claim 1, wherein the fiber swelling or dispersing agent comprises an ethylene oxide derivative of a fatty alcohol, fatty acid or alkyl phenol in which the proportion of ethylene oxide in the molecule exceeds 70% by mass.

9. The method as claimed in claim 1, wherein the permonosulphuric acid is used at a level of from 0.1 to 6.0% by weight on the weight of the dry wool.

10. The method as claimed in claim 1, wherein the scouring or wetting agent is used in an amount of from 0.25 to 10.0% by weight on the weight of the dry wool.

11. The method as claimed in claim 1, wherein the fiber swelling or dispersing agent is used in an amount of from 0.1 to 10.0% by weight on the weight of the dry wool.

12. The method as claimed in claim 1, and which is carried out as a continuous treatment.

* * * * *